US010690328B2

(12) United States Patent
Li

(10) Patent No.: US 10,690,328 B2
(45) Date of Patent: Jun. 23, 2020

(54) ADJUSTABLE SUPPORTING FRAME AND ADJUSTABLE LIGHTING DEVICE INCLUDING SAME

(71) Applicant: SHENZHEN GOALSUN OPTOELECTRONICS TECHNOLOGY CO., LTD, Shenzhen (CN)

(72) Inventor: Yongming Li, Shenzhen (CN)

(73) Assignee: SHENZHEN GOALSUN OPTOELECTRONTCS TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/554,632

(22) Filed: Aug. 29, 2019

(65) Prior Publication Data

US 2020/0032990 A1 Jan. 30, 2020

(30) Foreign Application Priority Data

Jul. 25, 2018 (CN) ..... 2018 2 1184018 U

(51) Int. Cl.

| | |
|---|---|
| ***F21S 8/00*** | (2006.01) |
| ***F21V 21/28*** | (2006.01) |
| ***F21V 29/74*** | (2015.01) |
| ***F21V 21/108*** | (2006.01) |

(52) U.S. Cl.
CPC ..... *F21V 21/28* (2013.01); *F21V 21/108* (2013.01); *F21V 29/74* (2015.01)

(58) Field of Classification Search
CPC ..... F21V 21/28; F21V 21/108; F21V 29/74; F21S 2/005
USPC ..... 362/427
See application file for complete search history.

(56) References Cited

U.S. PATENT DOCUMENTS

| | | | | |
|---|---|---|---|---|
| 7,832,901 | B2 * | 11/2010 | Ladewig | F21V 14/02 362/269 |
| 9,234,647 | B2 * | 1/2016 | Gabrius | F21V 29/713 |
| 9,243,786 | B1 * | 1/2016 | Onda | F21V 21/14 |

* cited by examiner

*Primary Examiner* — Ali Alavi

(57) ABSTRACT

An adjustable supporting frame includes a fixing element, a first adjusting member, and at least one second adjusting member. The first adjusting member includes a first rotating portion and a second rotating base. The first rotating portion rotatably coupled to the first rotating base. The second adjusting member includes a second rotating portion and a third rotating base. The second rotating portion is rotatably coupled to the second rotating base. The third rotating base is configured to couple to a product. An adjustable lighting device having the adjustable supporting frame is also provided. The adjustable lighting device can achieve a large adjustment range and a large illumination range.

20 Claims, 5 Drawing Sheets

ADJUSTABLE SUPPORTING FRAME AND ADJUSTABLE LIGHTING DEVICE INCLUDING SAME

FIELD

This disclosure relates to an adjustable supporting frame and an adjustable lighting device having the supporting frame.

BACKGROUND

A conventional lighting device is fixed in a site to emit light. However, orientations of the lighting devices generally cannot be changed or adjusted according to actual conditions. Therefore, there is room for improvement in the art.

SUMMARY

The disclosure provides an adjustable supporting frame. The adjustable supporting frame comprises a fixing element, a first adjusting member, and at least one second adjusting member. The fixing element comprises a first rotating base. The first adjusting member comprises a first rotating portion and a second rotating base coupled to the first rotating portion. The first rotating portion is rotatably coupled to the first rotating base by at least one rotary connecting member. Each second adjusting member each comprises a second rotating portion and a third rotating base coupled to the second rotating portion. The second rotating portion is rotatably coupled to the second rotating base. The third rotating base is configured to couple to a product.

In one aspect, the first rotating base comprises two mounting arms spaced apart from each other; each of the two mounting arms defines a first mounting hole for mounting the rotary connecting member; the first rotating portion is rotatably coupled to the two mounting arms and between the two mounting arms.

In one aspect, the first rotating portion and the second rotating base are coupled to be a crisscross structure.

In one aspect, the first rotating portion has opposite sides, and each of the opposite sides of the first rotating portion is coupled to a first bending portion; the first bending portion defines a second mounting hole for mounting one rotary connecting member; the first bending portion is rotatably coupled to one of the two mounting arms.

In one aspect, the second rotating base has opposite sides, and each of the opposite sides of the second rotating base is coupled to a second bending portion; the second bending portion defines a first mounting hole for mounting one rotating connecting member; the second bending portion is rotatably coupled to the second rotating portion.

In one aspect, the at least one second adjusting member comprises two second adjusting members, each of the two second adjusting members is coupled to one of opposite sides of the second rotating base.

In one aspect, each of the two second adjusting members is a sheet-like structure; and a middle portion of the second adjusting member forms the second rotating portion; the second rotating portion defines a second mounting hole for connecting one rotary connecting member.

In one aspect, the second adjusting member have opposite edge portions, each of the opposite edge portions of the second adjusting member forms the third rotating base; the second rotating portion is between two third rotating bases; the third rotating base defines a first mounting hole for mounting one rotary connecting member.

In one aspect, the adjustable supporting frame further comprises guiding connecting members, each of the first rotating base and the second rotating base defines a mounting hole for mounting one of the guiding connecting members; and each of the first rotating portion and the second rotating portion defines an arcuate through hole sliding engagement with one of the guiding connecting members.

In one aspect, each of the first rotating portion and the second rotating base defines at least one through hole to reduce weight.

The disclosure further provides an adjustable lighting device. The lighting device includes the above described adjustable supporting frame and at least one light assembly rotatably coupled to the third rotating base.

The adjustable supporting frame can realize fixing by the fixing element, and can realize rotation adjustments in two directions by the first adjusting member and the second adjusting member, has a larger adjustment range, and the second adjusting member provides the third rotating base to connect the product to be adjusted, thus the product has a larger adjustment range and a larger action range.

BRIEF DESCRIPTION OF THE DRAWINGS

Implementations of the present technology will now be described, by way of embodiment, with reference to the attached figures.

DETAILED DESCRIPTION

Figure 1:
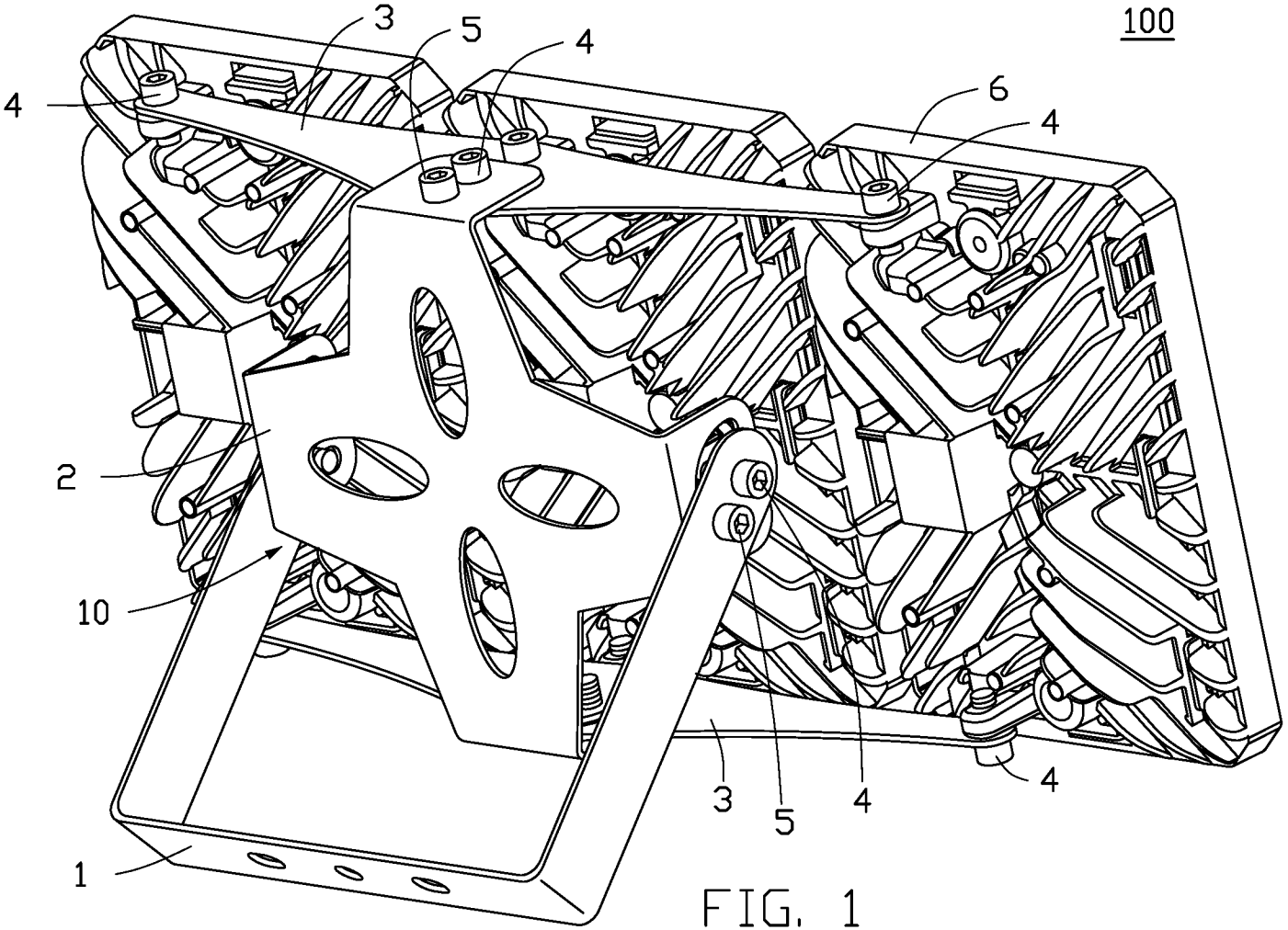
FIG. 1 is an isometric view of a lighting device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "coupled" is defined as coupled, whether directly or indirectly through intervening components, and is not necessarily limited to physical connections. The connection can be such that the objects are permanently coupled or releasably coupled. The term "comprising" when utilized, means "including, but not necessarily limited to"; it specifically indicates open-ended inclusion or membership in the so-described combination, group, series, and the like.

FIG. 1 illustrates a lighting device 100. The lighting device 100 includes a supporting frame 10 and at least one light assembly 6 mounted on the supporting frame 10. The supporting frame 10 is configured to support and hold the light assembly 6. The supporting frame 10 is adjustable/rotatable, thus orientation of the light assembly 6 can be adjusted. It can be understood that the supporting frame 10 can support and hold other products, not limited to the light assembly 6.

Figure 2:
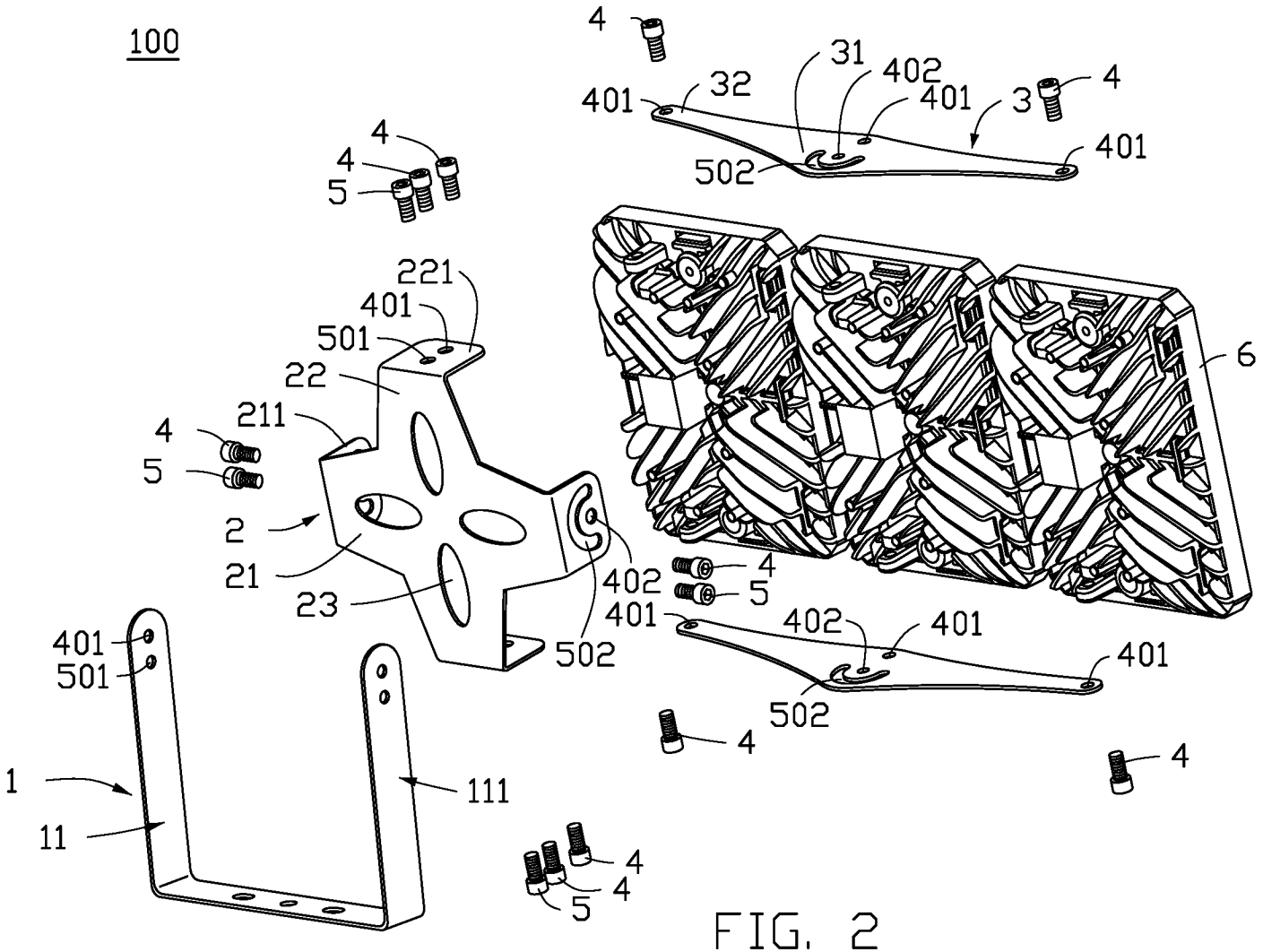
FIG. 2 is an exploded view of the lighting device of FIG. 1.
Figure 3:
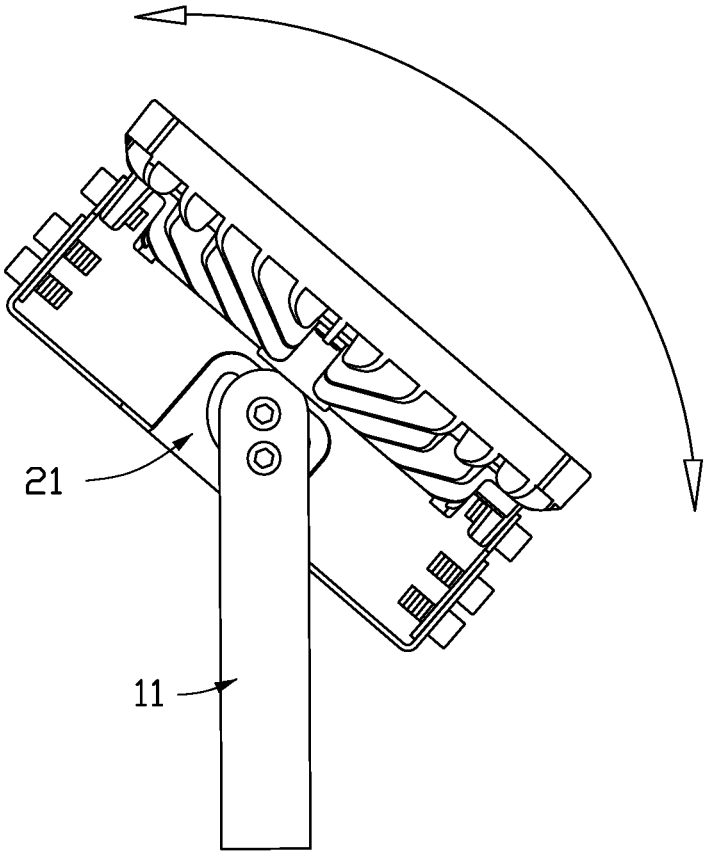
FIG. 3 is a view showing a rotation action of first adjusting member of the lighting device of FIG. 1.
Figure 4:
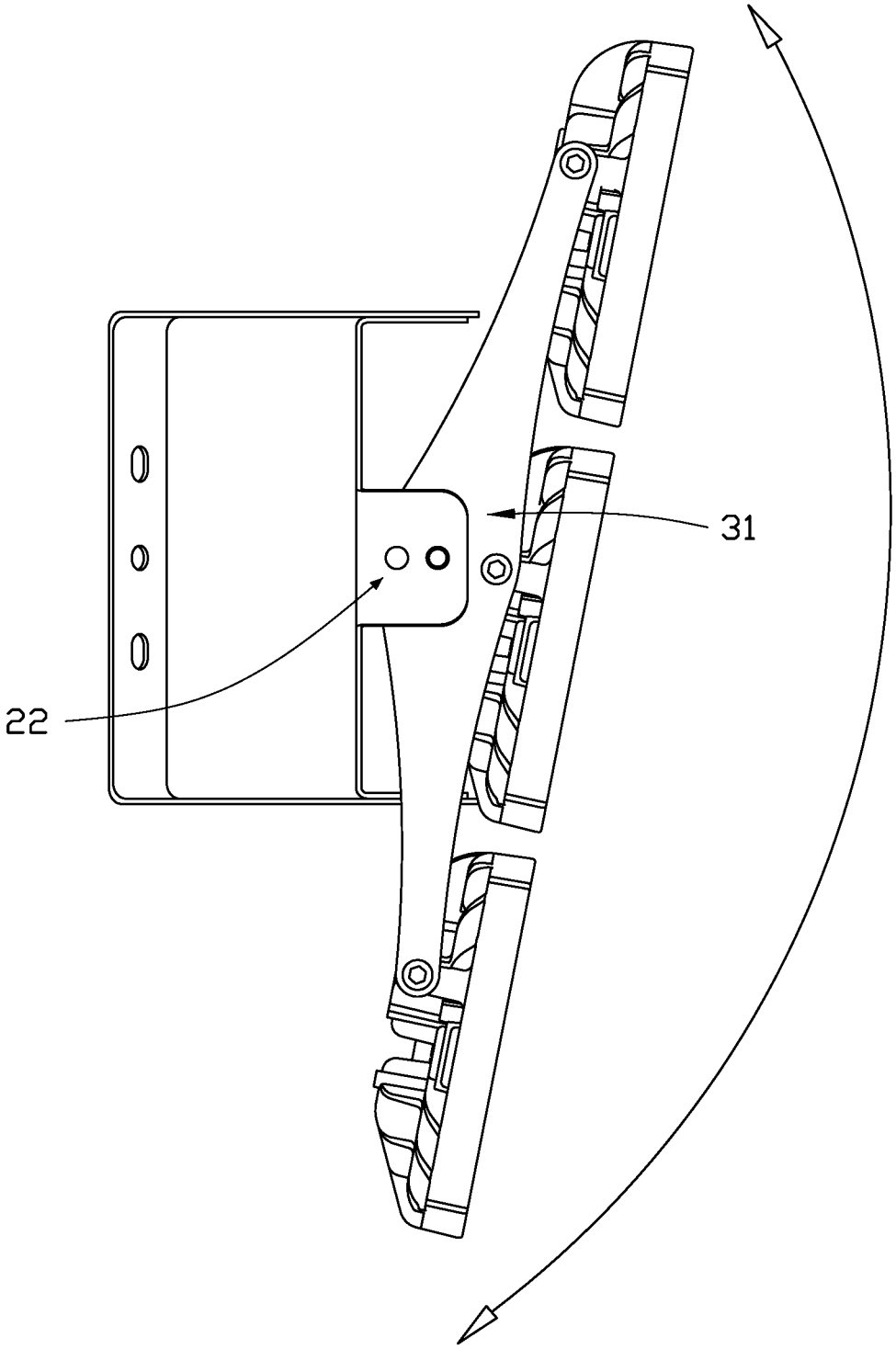
FIG. 4 is a view showing a rotation action of a second adjusting member of the lighting device of FIG. 1.
Figure 5:
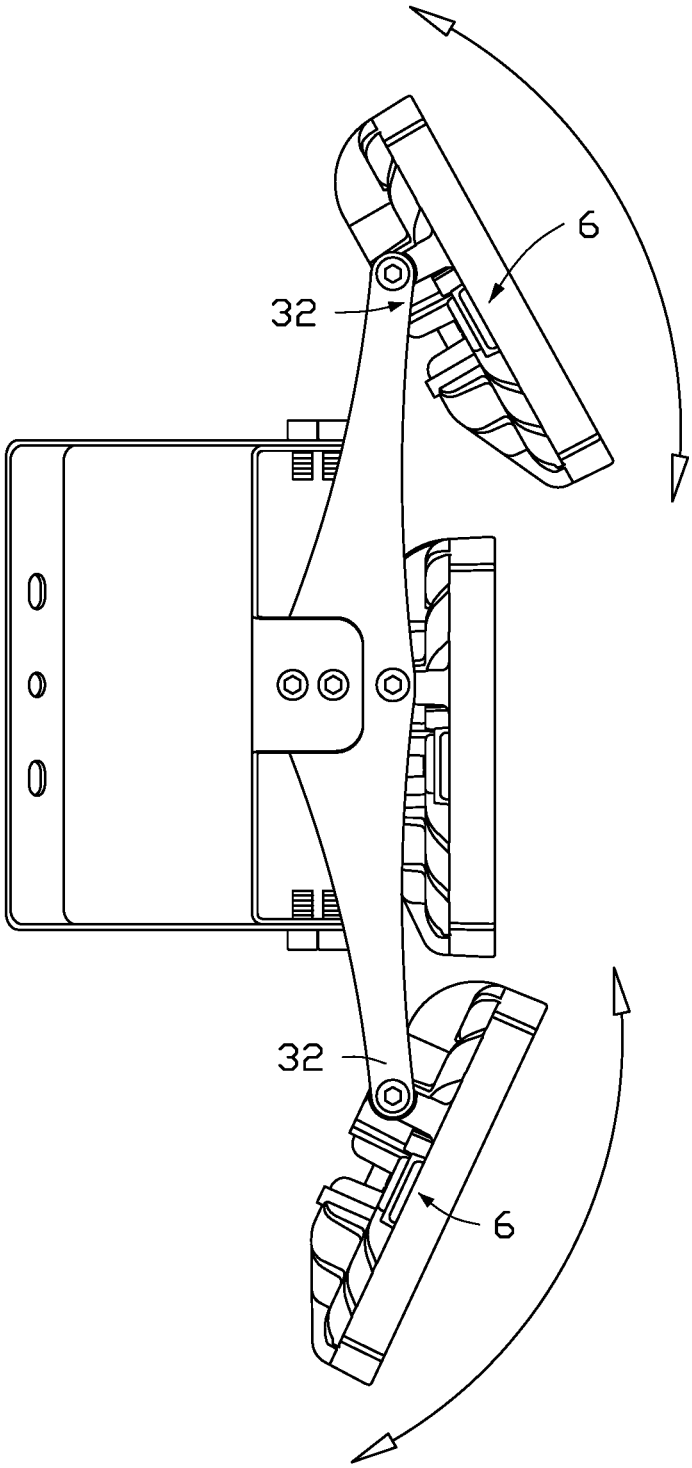
FIG. 5 is a view showing a rotation action of light assemblies of the lighting device of FIG. 1.

As shown in FIG. 1, the supporting frame 10 includes a fixing element 1, a first adjusting member 2, and at least one second adjusting member 3. As shown in FIG. 2, the fixing element 1 includes a first rotating base 11. The first adjusting member 2 includes a first rotating portion 21 and a second rotating base 22 coupled to the first rotating portion 21. The second adjusting member 3 includes a second rotating portion 31 and a third rotating base 32 coupled to the second rotating portion 31. The first rotating portion 21 can rotate relative to the first rotating base 11 to adjust an orientation of a product (for example the light assembly 6) mounted on the supporting frame 10 in a first direction, as shown in FIG. 3. The second rotating portion 31 can rotate relative to the second rotating base 22 so as to adjust the orientation of the product (for example the light assembly 6) mounted on the supporting frame 10 in a second direction that is not parallel to the first direction, as shown in FIG. 4. As shown in FIG. 5, the product to be adjusted, such as the light assembly 6, can rotate relative to the third rotating base 32 to adjust an orientation of the light assembly 6, thus illumination range of the light assembly 6 can be changed/adjusted. Specifically, the first rotating portion 21 is rotatably coupled to the first rotating base 11 by rotary connecting members 4, and the second rotating portion 31 is rotatably coupled to the second rotating base portion 22 by other rotary connecting members 4.

In one embodiment, the first rotating portion 21 is hingedly coupled to the first rotating base 11, and the second rotating portion 31 is hingedly coupled to the second rotating base 22.

In one embodiment, the rotating connecting member 4 can be a rod-shaped structure capable of being rotatably connected and locked, such as a pin, a rivet, a snap fastener or a threaded fastener. When the adjustment is required, the rotary connecting member 4 of a to-be-adjusted portion is loosened, and the rotary connecting 4 is locked after the adjustment is completed. In one embodiment, the rotating connecting member 4 is a bolt, such as a hexagon socket head bolt, which is convenient to install and disassemble, and requires less installation space, so that the the supporting frame 10 has a compact structure.

As shown in FIG. 2, the first rotating base 11 includes two mounting arms 111 spaced apart from each other. Each mounting arm 111 defines a first mounting hole 401 for mounting the rotating connecting member 4. The first adjusting member 2 is between the two mounting arms 111. The mounting arms 111 can support the first adjusting member 2 on opposite sides, and the supporting frame 10 can have a compact and stable structure.

As shown in FIG. 2, the first rotating portion 21 and the second rotating base 22 are coupled to be a crisscross structure, and the first rotating portion 21 and the second rotating base 22 intersect perpendicularly to each other, such that the first direction and the second direction are perpendicular to each other. Thus, an adjustment region along the first direction and an adjustment region along the second direction do not overlap with each other to achieve a larger adjustment range. On the other hand, every portions of the first adjustment member 2 are evenly stressed. In other embodiment, the first rotating portion 21 and the second rotating base 22 may also be disposed in an obliquely intersecting configuration.

When the first rotating portion 21 and the second rotating base 22 are coupled to be a crisscross structure, each of the first rotating portion 21 and the second rotating base 22 may be wide in a middle and narrow at opposite ends. "Wide in a middle" can ensure an adequate structural strength of the first adjusting member 2, "narrow at opposite ends" can ensure an adequate adjustment space of the second adjusting member 3 to avoid interference and form a large adjustment range.

As shown in FIG. 2, the first rotating portion 21 has opposite sides, and each side of the first rotating portion 21 is coupled to a first bending portion 211. The second rotating base 22 has opposite sides, and each side of the second rotating base 22 is coupled to a second bending portion 221. The first bending portion 211 defines a second mounting hole 402 for mounting a rotating connecting member 4. The second bending portion 221 defines a first mounting hole 401 for mounting a rotating connecting member 4. The first bending portion 211 and the second bending portion 221 are provided to increase an installation space and make connecting and adjusting easy.

Each of the first rotating portion 21 and the second rotating base 22 defines at least one through hole 23 to reduce weight and/or to mount the first adjusting member 2. In the present embodiment, as shown in FIG. 2, each of the first rotating portion 21 and the second rotating base 22 defines two through holes 23.

In the present embodiment, the at least one second adjusting member 3 is two second adjusting members 3. Each second adjusting member 3 is coupled to one of the opposite sides of the second rotating base 22. A space for mounting the product to be adjusted is formed between the two second adjusting members 3, which can reduce an occupation space of the first adjusting member 2 and have better adaptability. In other embodiment, there can be only one second adjusting member 3. For example, the above two second adjusting members 3 are coupled to be a unitary structure.

As shown in FIG. 2, the second adjusting member 3 is a sheet-like structure, and a middle portion of the second adjusting member 3 forms the second rotating portion 31. The second rotating portion 31 is the middle portion of the second adjusting member 3, which can form uniform adjustment and uniform force on both sides of the second adjusting member 3. The second rotating portion 31 defines a second mounting hole 402 for connecting a rotary connecting member 4.

The second adjusting member 3 have opposite edge portions, and each edge portion of the second adjusting member 3 forms the third rotating base 32. Thus, an effect region of the product coupled to the third rotating base 32 can be adjusted. The third rotating base 32 defines a first mounting hole 401 for mounting a rotary connecting member 4. It can be understood that the middle portion of the second adjusting member 3 can also form one third rotating base 32.

As shown in FIG. 2, the supporting frame 10 further includes guiding connecting members 5. When adjusting the second adjusting member 3, the guiding connecting member 5 can play a guiding and reference role for controlling adjusting orientations. When the guiding connecting member 5 is locked, the guiding connecting member 5 can play a fixing role. That is, the guiding connecting member 5 and the rotating connecting member 4 cooperate to form two points fixing to effectively prevent rotation. Each of the mounting arms 111 of the first rotating base 11 and the second bending portion 221 define a third mounting holes 501 for mounting the guiding connecting member 5. Each of the first bending portion 211 and the second rotating portion 31 defines an arcuate through hole 502 sliding engagement with the guiding connecting member 5. The arcuate through hole 502 is provided to match a moving path of the guiding connecting member 5.

The guiding connecting member 5 can be a rod-shaped structure capable of being rotatably connected and locked, such as a pin, a rivet, a snap fastener or a threaded fastener. In the present embodiment, the guiding connecting member 5 and the the rotary connecting member 4 are the same in order to reduce a complexity of machining and assembly.

The first mounting hole 401 supports the rotary connecting member 4, and the first mounting hole 401 may be rotational fit or fixed fit with the rotary connecting member 4. The first mounting hole 401 can fixed fit with the rotary connecting member 4 to reduce wear. For example, when the rotary connecting member 4 is a bolt, the first mounting hole 401 may be provided as an internal thread structure to reduce use of fastening nut, thereby saving cost and simplifying assembly process. The second mounting hole 402 may be rotatably engaged with the rotary connecting 4 to realize rotation adjustment. The third mounting hole 501 may be rotational fit or a fixed fit with the guide connector 5, and also may be fixed fit to reduce wear. The first mounting hole 401 and the third mounting hole 501 can be the same.

The present disclosure further provides the lighting device 100 including the above supporting frame 10 and the at least one light assembly 6. The light assembly 6 is rotatably coupled to the third rotating base 32. A second mounting hole 402 for mounting the rotary connecting member 4 may be defined in each of opposite ends of the light assembly 6. Each light assembly 6 is coupled to the third rotating base 32 by the rotary connecting member 4. A number of the at least one light assembly 6 can be multiple.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. An adjustable supporting frame, comprising:

a fixing element comprising a first rotating base;

a first adjusting member comprising a first rotating portion and a second rotating base coupled to the first rotating portion, the first rotating portion being rotatably coupled to the first rotating base by at least one rotary connecting member; and at least one second adjusting member each comprising a second rotating portion and a third rotating base coupled to the second rotating portion, the second rotating portion being rotatably coupled to the second rotating base, the third rotating base being configured to couple to a product.

2. The adjustable supporting frame of claim 1, wherein the first rotating base comprises two mounting arms spaced apart from each other; each of the two mounting arms defines a first mounting hole for mounting the rotary connecting member; the first rotating portion is rotatably coupled to the two mounting arms and between the two mounting arms.

3. The adjustable supporting frame of claim 2, wherein the first rotating portion and the second rotating base are coupled to be a crisscross structure.

4. The adjustable supporting frame of claim 3, wherein the first rotating portion has opposite sides, and each of the opposite sides of the first rotating portion is coupled to a first bending portion; the first bending portion defines a second mounting hole for mounting one rotary connecting member; the first bending portion is rotatably coupled to one of the two mounting arms.

5. The adjustable supporting frame of claim 4, wherein the second rotating base has opposite sides, and each of the opposite sides of the second rotating base is coupled to a second bending portion; the second bending portion defines a first mounting hole for mounting one rotating connecting member; the second bending portion is rotatably coupled to the second rotating portion.

6. The adjustable supporting frame of claim 1, wherein the at least one second adjusting member comprises two second adjusting members, each of the two second adjusting members is coupled to one of opposite sides of the second rotating base.

7. The adjustable supporting frame of claim 6, wherein each of the two second adjusting members is a sheet-like structure; and a middle portion of the second adjusting member forms the second rotating portion; the second rotating portion defines a second mounting hole for connecting one rotary connecting member.

8. The adjustable supporting frame of claim 7, wherein the second adjusting member have opposite edge portions, each of the opposite edge portions of the second adjusting member forms the third rotating base; the second rotating portion is between two third rotating bases; the third rotating base defines a first mounting hole for mounting one rotary connecting member.

9. The adjustable supporting frame of claim 1, further comprising guiding connecting members, wherein each of the first rotating base and the second rotating base defines a mounting hole for mounting one of the guiding connecting members; and each of the first rotating portion and the second rotating portion defines an arcuate through hole sliding engagement with one of the guiding connecting members.

10. The adjustable supporting frame of claim 1, wherein each of the first rotating portion and the second rotating base defines at least one through hole to reduce weight and/or to mount the first adjusting member.

11. An adjustable lighting device, comprising:

an adjustable supporting frame, the adjustable supporting frame comprising:

a fixing element comprising a first rotating base;

a first adjusting member comprising a first rotating portion and a second rotating base coupled to the first rotating portion, the first rotating portion rotatably coupled to the first rotating base by at least one rotary connecting member; and at least one second adjusting member each comprising a second rotating portion and a third rotating base coupled to the second rotating portion, the second rotating portion rotatably coupled to the second rotating base; and at least one light assembly rotatably coupled to the third rotating base.

12. The adjustable lighting device of claim 11, wherein the first rotating base comprises two mounting arms spaced apart from each other; each of the two mounting arms defines a first mounting hole for mounting the rotary connecting member; the first rotating portion is rotatably coupled to the two mounting arms and between the two mounting arms.

13. The adjustable lighting device of claim 12, wherein the first rotating portion and the second rotating base are coupled to be a crisscross structure.

14. The adjustable lighting device of claim 13, wherein the first rotating portion has opposite sides, and each of the opposite sides of the first rotating portion is coupled to a first bending portion; the first bending portion defines a second mounting hole for mounting one rotary connecting member; the first bending portion is rotatably coupled to one of the two mounting arms.

15. The adjustable lighting device of claim 14, wherein the second rotating base has opposite sides, and each of the opposite sides of the second rotating base is coupled to a second bending portion; the second bending portion defines a first mounting hole for mounting one rotating connecting member; the second bending portion is rotatably coupled to the second rotating portion.

16. The adjustable lighting device of claim 11, wherein the at least one second adjusting member comprises two second adjusting members, each of the two second adjusting members is coupled to one of opposite sides of the second rotating base.

17. The adjustable lighting device of claim 16, wherein each of the two second adjusting members is a sheet-like structure; and a middle portion of the second adjusting member forms the second rotating portion; the second rotating portion defines a second mounting hole for connecting one rotary connecting member.

18. The adjustable lighting device of claim 17, wherein the second adjusting member have opposite edge portions, each of the opposite edge portions of the second adjusting member forms the third rotating base; the second rotating portion is between two third rotating bases; the third rotating base defines a first mounting hole for mounting one rotary connecting member.

19. The adjustable lighting device of claim 11, further comprising guiding connecting members, wherein each of the first rotating base and the second rotating base defines a mounting hole for mounting one of the guiding connecting members; and each of the first rotating portion and the second rotating portion defines an arcuate through hole sliding engagement with one of the guiding connecting members.

20. The adjustable lighting device of claim 11, wherein each of the first rotating portion and the second rotating base defines at least one through hole to reduce weight.

* * * * *